US007096184B1

(12) United States Patent
Ahroon

(10) Patent No.: US 7,096,184 B1
(45) Date of Patent: Aug. 22, 2006

(54) CALIBRATING AUDIOMETRY STIMULI

(75) Inventor: William A. Ahroon, Enterprise, AL (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 592 days.

(21) Appl. No.: 10/025,725

(22) Filed: Dec. 18, 2001

(51) Int. Cl.
*G10L 21/00* (2006.01)

(52) U.S. Cl. ..... 704/270; 704/225; 704/226

(58) Field of Classification Search ..... 704/225–228, 704/200, 233
See application file for complete search history.

(56) References Cited

U.S. PATENT DOCUMENTS 5,687,285 A * 11/1997 Katayanagi et al. ..... 704/226
5,752,226 A * 5/1998 Chan et al. ..... 704/233
5,974,373 A * 10/1999 Chan et al. ..... 704/200
6,453,289 B1 * 9/2002 Ertem et al. ..... 704/225

OTHER PUBLICATIONS

M.M. Taylor, *PEST: Efficient Estimates on Probability Function*, The Journal of the Acoustical Society of America, vol. 41, No. 4, pp. 782-787, Jan. 1967.
Audiologists' Desk Reference, vol. 1, pp. 82-84, 1997.
*Parrot Software*, pp. 1-36, 2000-2001.

* cited by examiner

*Primary Examiner*—Richemond Dorvil
*Assistant Examiner*—Huyen X. Vo
(74) *Attorney, Agent, or Firm*—Elizabeth Arwine

(57) ABSTRACT

In one embodiment, a method is characterized by accepting voice input defining at least one spoken word; and calibrating the at least one spoken word in response to at least one defined speech-energy criterion. In one embodiment, a related system includes but is not limited to circuitry and/or programming for effecting the foregoing-referenced method embodiment; the circuitry and/or programming can be virtually any combination of hardware, software, and/or firmware configured to effect the foregoing-referenced method embodiments depending upon the design choices of the system designer.

23 Claims, 13 Drawing Sheets

Example of Calculation and
Creation of Scaled
Waveform

Assumed Target RMS Value = 500.

Assumed Tolerance Values = +/- 1% of Target RMS Value
(i.e., 495 < Calculated RMS < 505).

Assumed Measured Waveform Values = 0, 234, 0, -134, 0.

Squared Waveform Values = 0, 54756, 0, 17956, 0

Sum of Squared Waveform Values = 72712.

Calculated RMS = Square Root of Sum of Squared Waveform Values

Calculated RMS = 269.6516.

Calculate Scaling Factor Since Calculated RMS
is Not Within Defined Tolerance = Target RMS Value/Calculated RMS = 500/296.6516
= 1.854244

Scaled Assumed Measured Waveform Values = Target Values * Scaling Factor =
Creation of Scaled Waveform = 433.8932, 234, 0, -248.469, 0.

Check That Scaled Waveform Values Within Tolerance:

Squared Scaled Waveform Values = 188263.3, 0, 61736.71, 0.

Sum of Squared Scaled Waveform Values = 250000.

Calculated RMS of Scaled Values = 500, which is within defined defined tolerance values about the target RMS value.

*Fig. 11*

CALIBRATING AUDIOMETRY STIMULI

STATEMENT REGARDING FEDERALLY SPONSORED RESEARCH OR DEVELOPMENT

This invention was made with government support provided by the United States Army. The government has certain rights in this invention.

CROSS-REFERENCE TO RELATED APPLICATION

This patent application incorporates by reference in its entirety the subject matter of the currently co-pending U.S. Patent Application entitled, DETERMINING SPEECH RECEPTION THRESHOLD, naming William A. Ahroon as inventor, filed substantially contemporaneously herewith.

This patent application incorporates by reference in its entirety the subject matter of the currently co-pending U.S. Patent Application entitled, DETERMINING SPEECH INTELLIGIBILITY, naming William A. Ahroon as inventor, filed substantially contemporaneously herewith.

BACKGROUND OF THE INVENTION

1. Field of the Invention

The present application relates, in general, to audiometry. The present application relates, in particular, to speech audiometry 2. Description of the Related Art Audiometry is the testing of hearing acuity by use of an audiometer. An audiometer is an instrument for gauging and recording the acuity of human hearing.

There are various types of testing used in audiometry (e.g., pure-tone testing or speech-based testing). In pure-tone testing, a person is usually fitted with headphones or positioned between speakers, and thereafter a series of single-tone (or frequency) sounds are played back through the headphones or speakers. The person's responses to the played-back sounds are recorded (typically by a human tester, but sometimes by a machine), and an assessment of the person's hearing acuity is made on the bases of the person's responses. In speech-based testing, like in pure-tone testing, a person is usually fitted with headphones or positioned between speakers. However, unlike pure-tone testing, in speech-based testing a series of spoken words are played back through the headphones or speakers. The person's responses to the spoken are recorded (typically by a human tester), and an assessment of the person's hearing acuity is made on the bases of the person's responses.

BRIEF SUMMARY OF THE INVENTION

The inventor has devised a method and system which improve upon related-art speech-based audiometry.

In one embodiment, the method is characterized by accepting voice input defining at least one spoken word; and calibrating the at least one spoken word in response to at least one defined speech-energy criterion.

In one embodiment, a related system includes but is not limited to circuitry and/or programming for effecting the foregoing-referenced method embodiment; the circuitry and/or programming can be virtually any combination of hardware, software, and/or firmware configured to effect the foregoing-referenced method embodiments depending upon the design choices of the system designer.

In one or more various embodiments, related systems include but are not limited to circuitry and/or programming for effecting the foregoing-referenced method embodiments; the circuitry and/or programming can be virtually any combination of hardware, software, and/or firmware configured to effect the foregoing-referenced method embodiments depending upon the design choices of the system designer.

The foregoing is a summary and thus contains, by necessity; simplifications, generalizations and omissions of detail; consequently, those skilled in the art will appreciate that the summary is illustrative only and is NOT intended to be in any way limiting. Other aspects, inventive features, and advantages of the devices and/or processes described herein, as defined solely by the claims, will become apparent in the non-limiting detailed description set forth herein.

BRIEF DESCRIPTION OF THE SEVERAL VIEWS OF THE DRAWING(S)

FIGS. 1A–C, show, among other things, an environment wherein processes described herein may be implemented.

FIG. 11 shows an example of RMS calculation involving an assumed RMS, assumed tolerance values of +/−1% about the assumed target values, subsequent calculation of a scaling factor, and subsequent resultant scaled waveform values.

The use of the same symbols in different drawings typically indicates similar or identical items.

DETAILED DESCRIPTION OF THE INVENTION

Figure 1A:
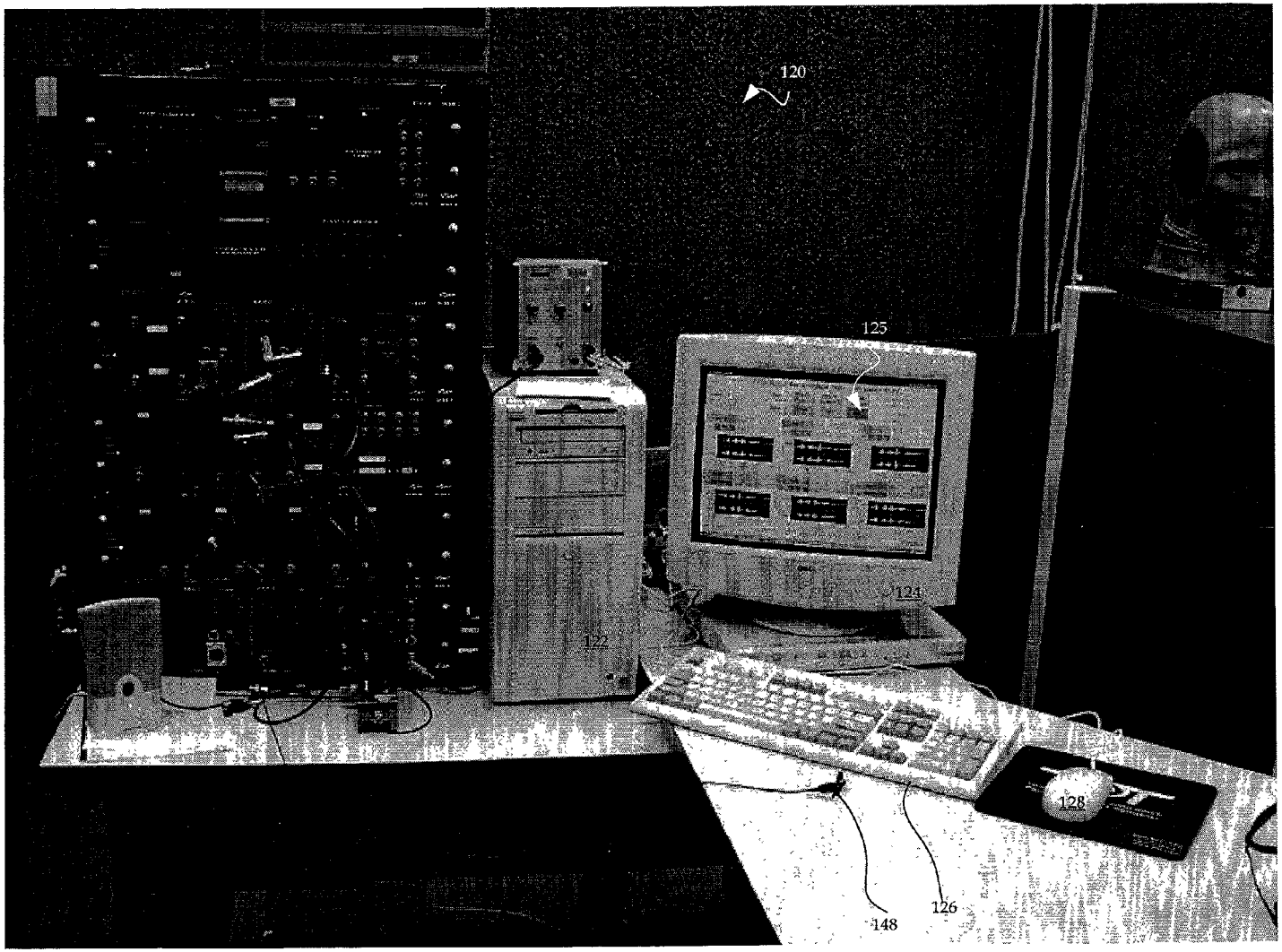

As described in the "description of related art section", above, in related-art speech-based audiometry, a person whose hearing is being tested is exposed to a series of spoken words.

The inventor has discovered the heretofore unrecognized fact that related-art speech-based testing has inaccuracies arising from lack of precision with respect to exactly what the person whose hearing is being tested is exposed to, and that this lack of precision impacts upon the efficacy of related-art audiometry. Accordingly, the inventor has devised methods and systems which remedy the lack of precision of related-art speech-based testing.

The inventor has noticed that, as regards the words presented to an individual undergoing audiometry testing, there is typically no, or very little, control over the energy, or intensity, or loudness of the words presented to an individual under test. Consequently, the inventor has recognized that, insofar as many audiometry tests rely on variation of the loudnesses of the words played back to the person whose hearing is being tested, the fact that the presented words themselves may have been recorded with different energies (or intensities, or loudnesses) can introduce inaccuracies into speech-based testing. That is, insofar as the words might have been recorded (or captured) at different loudnesses, when such words are played back, such differences in the recorded loudnesses of the words can in and of themselves cause perceived variations in loudnesses of the played-back words, thereby adversely affecting the testing. An extreme example of the foregoing would be where a first word was spoken and recorded in a normal tone of voice, and a second word was spoken and recorded in a shouted tone of voice. Assuming the recording equipment itself were not altered between recording the two words, upon playback the second word would be perceived as appreciably louder than the first word, even if the gain of the playback system were kept constant across the two played-back words.

In light of the foregoing, the inventor has devised methods and systems whereby words to be used in audiometry testing can be "calibrated" such that the words have substantially the same sound energy. As will be discussed following, two of the common scales which the inventor has used to calibrate the words are the Root Mean Squared (RMS) values of waveforms representative of the words (e.g., voltage waveforms obtained via a microphone), and peak-to-peak values of waveforms representative of the words (e.g., voltage waveforms obtained via a microphone). However, it is to be understood that the methods and systems utilized herein are not limited to such scales. Rather, the methods and systems utilized herein may be extended to like systems where the words played back are calibrated against a common scale. For example, although peak-to-peak values are described herein for sake of illustration, those having ordinary skill in the art will recognize that the schemes described herein can be extended to use positive peak or peak magnitude scales via reasonable experimentation well within the ambit of one having ordinary skill in the art, and hence the present disclosure is not limited to the exemplary scales (e.g., RMS and peak-to-peak) described herein.

Figure 1B:
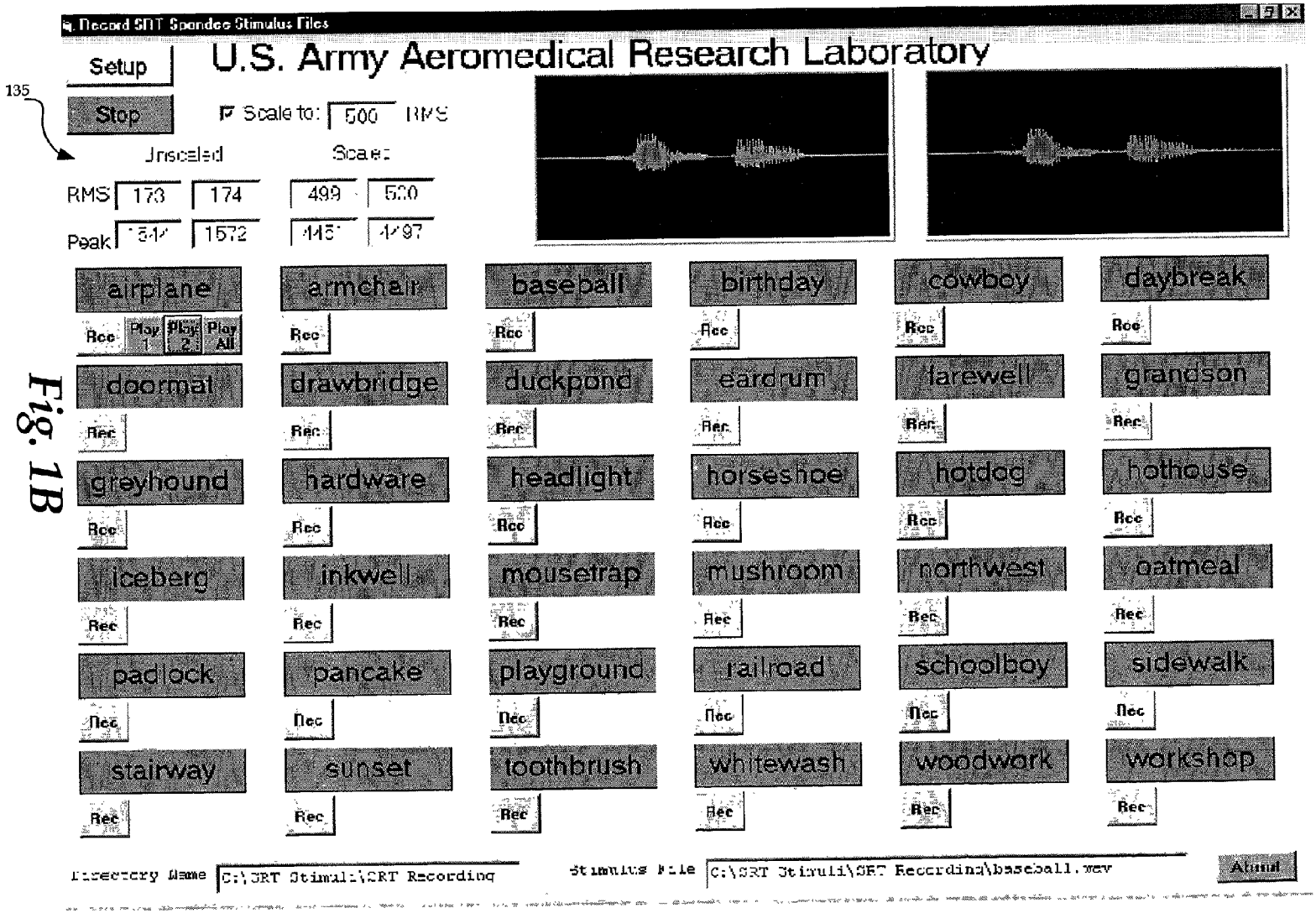
Figure 1C:
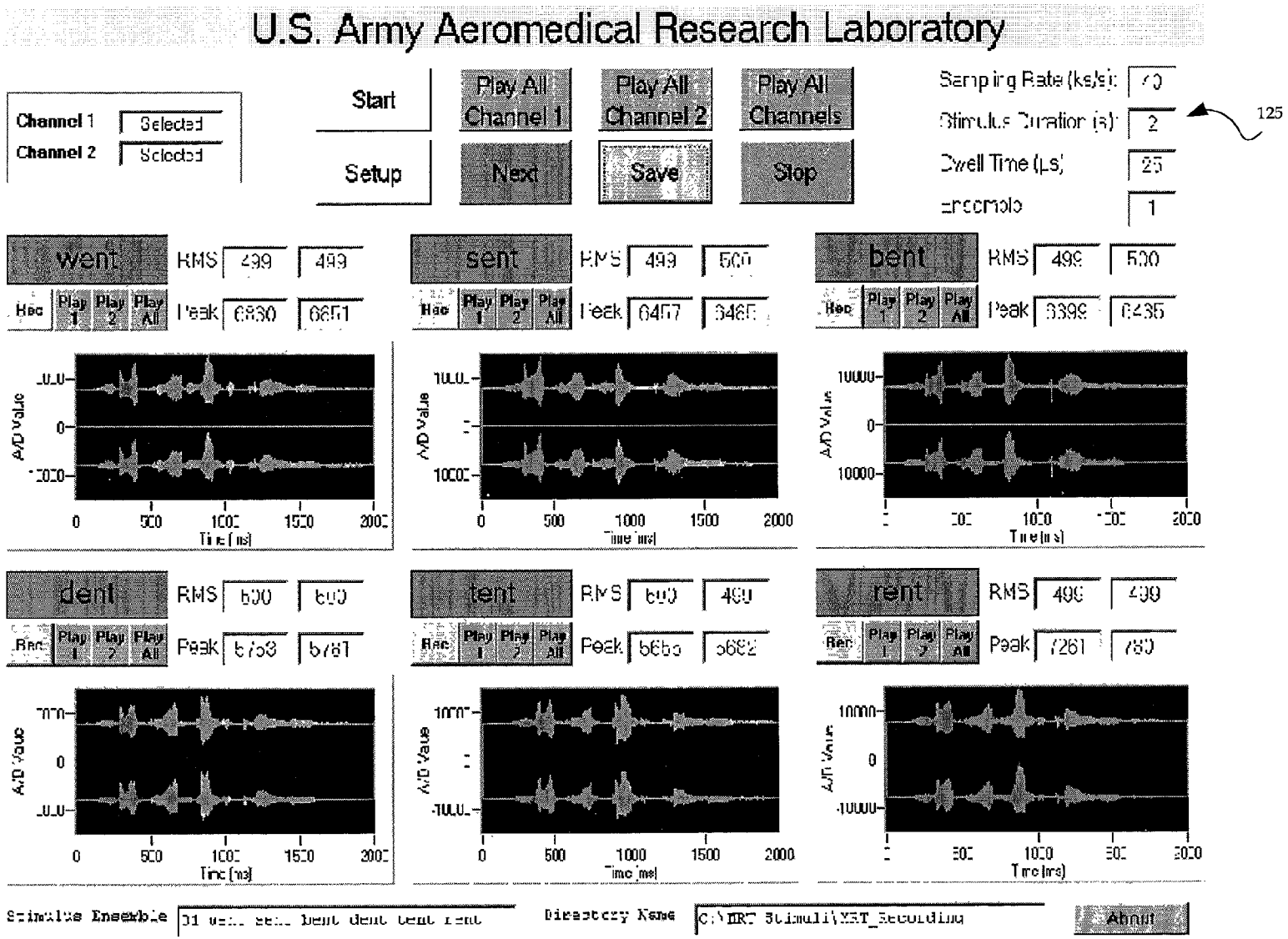

With reference to the figures, and in particular with reference now to FIGS. 1A–C, shown, among other things, is an environment wherein processes described herein may be implemented. Depicted is data processing system 120 which includes system unit 122, video display device 124 displaying Graphic User Interface (GUI) 125, keyboard 126, mouse 128, and microphone 148. Data processing system 120 may be implemented utilizing any suitable commercially available computer system. Video display device 124, keyboard 126, mouse 128, and microphone 148 are all under the control of or interact with a computer program running internal to data processing system 120.

Referring now to FIG. 1B, shown is a close-up view of GUI 135. Depicted is that GUI 135 has a number of clickable icons with each icon labeled with a spondee (e.g., the icons labeled "airplane", "armchair", "baseball", etc.). Illustrated are both "scaled" and "unscaled" GUI fields labeled "RMS," and "Peak Value," which are measured values in accordance with processes described herein. Also shown is a "scale to RMS value" field which can be adjusted by the audiologist or tester by pointing and clicking on the field and then using keyboard 126 to enter a new value. Also shown are graphical representations of the envelope of a voltage waveform representing a word recorded via microphone 148.

Referring now to FIG. 1C, shown is a close-up view of GUI 125 shown in FIG. 1A. Depicted is that GUI 125 has a number of graphical representations of the envelope of a voltage waveform representing a word recorded via microphone 148, with which are associated, for various words (e.g., the icons labeled "airplane", "armchair", "baseball", etc.), "scaled" "RMS," and "Peak Values," which are measured values in accordance with processes described herein. GUI 125 gives an overall feel for the intensities at which the various words have been recorded. The remaining fields depicted in GUI 125 are substantially self-explanatory.

Following are a series of flowcharts depicting implementations of processes. For ease of understanding, the flowcharts are organized such that the initial flowcharts present implementations via an overall "big picture" viewpoint, and thereafter the following flowcharts present alternate implementations and/or expansions of the "big picture" flowcharts as either substeps or additional steps building on one or more earlier-presented flowcharts. Those having ordinary skill in the art will appreciate that the style of presentation utilized herein (e.g., beginning with a presentation of a flowchart(s) presenting an overall view and thereafter providing additions to and/or further details in subsequent flowcharts) generally allows for a rapid and easy understanding of the various process implementations.

Figure 2:
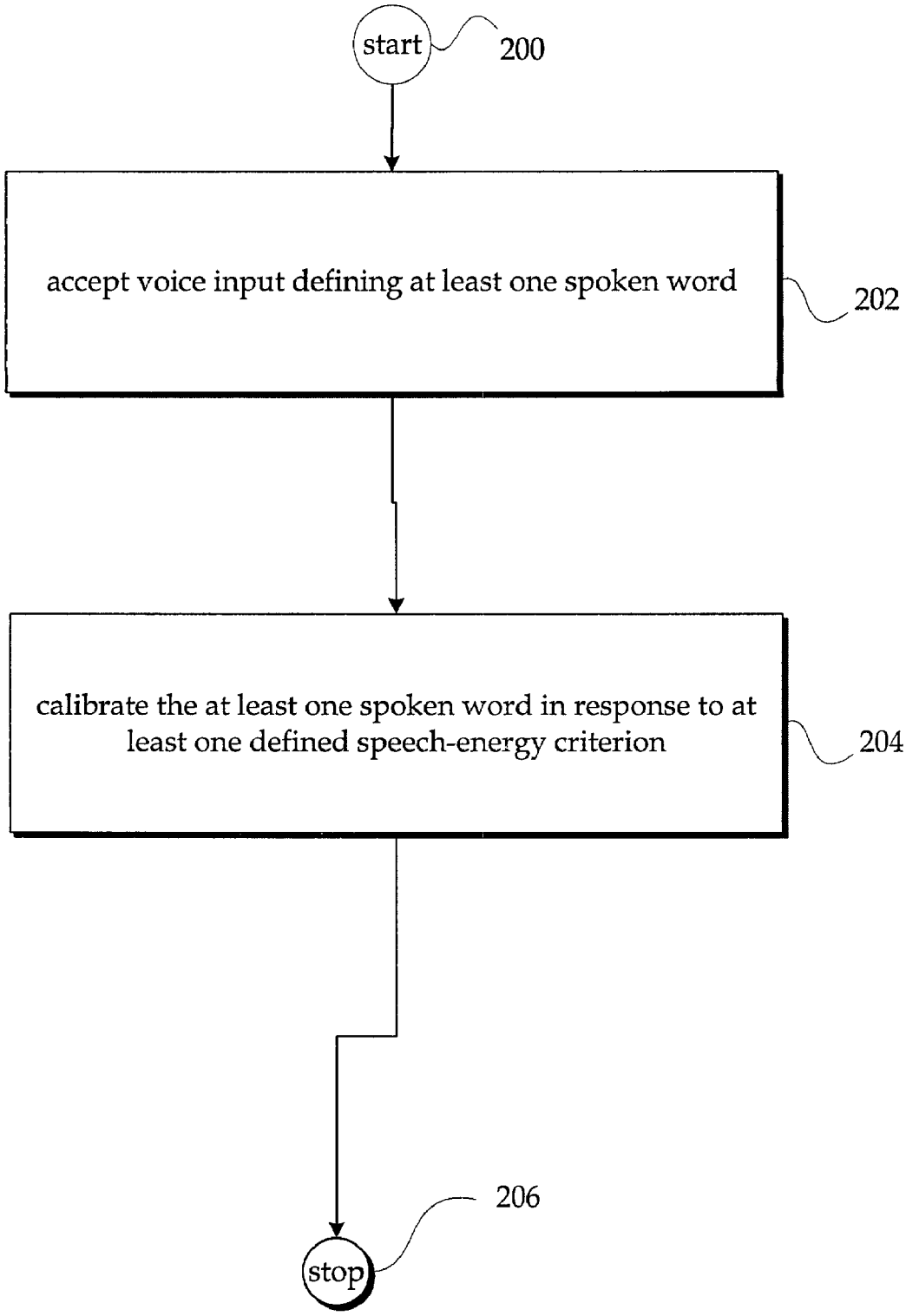
FIG. 2 shows a high-level logic flowchart depicting a process.

Referring now to FIG. 2, shown is a high-level logic flowchart depicting a process. Method step 200 illustrates the start of the process. Method step 202 depicts accepting voice input defining at least one spoken word. Method step 204 illustrates calibrating the at least one spoken word in response to at least one defined speech-energy criterion. Method step 206 shows the end of the process. In one device implementation, method step 202 is achieved via a computer program, running on data processing system 120, recording a signal from microphone 148 into a Microsoft WAV file. In one device implementation, method step 204 is achieved via a computer program, running on data processing system 120, calibrating the at least one spoken word in response to at least one defined speech-energy criterion by manipulating a data file having a discrete representation of a waveform representative of one or more spoken words (e.g., Microsoft WAV file containing a digital data representation of a voltage waveform representative a spoken word).

Figure 3:
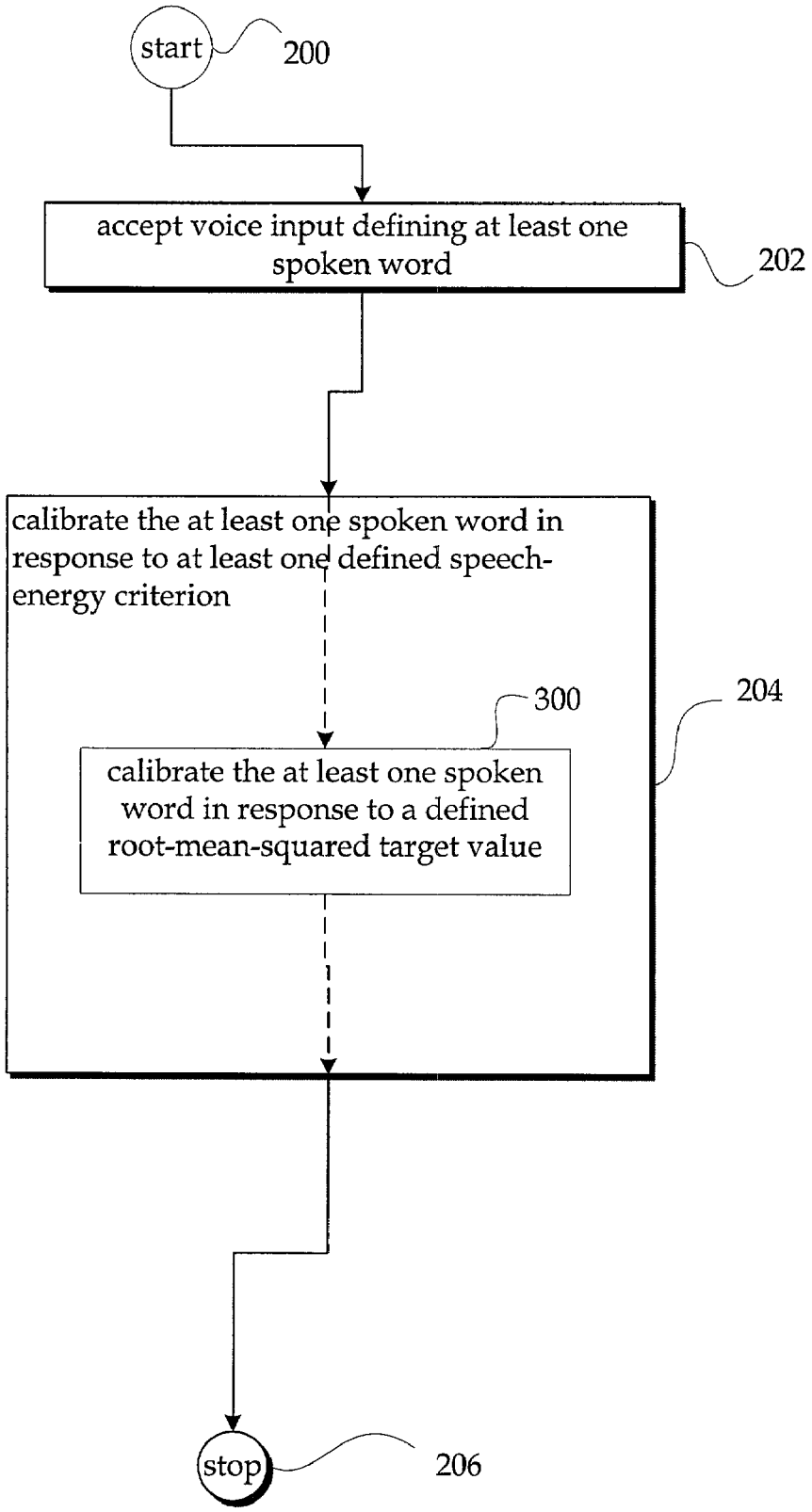
FIG. 3 shows an implementation of the high-level logic flowchart shown in FIG. 2.

With reference now to FIG. 3, shown is an implementation of the high-level logic flowchart shown in FIG. 2. Depicted in FIG. 3 is that in one implementation method step 204 can include method sub-step 300. Illustrated is that in one implementation calibrating the at least one word in response to at least one defined speech-energy criterion can include, but is not limited to, calibrating the at least one spoken word in response to a defined root-mean-squared target value. In one device implementation, method step 204 is achieved via a computer program, running on data processing system 120, calibrating the at least one spoken word in response to a defined root-mean-squared target value by manipulating a data file having a discrete representation of a waveform representative of a spoken word (e.g., a Microsoft WAV file containing a discrete data representation of a voltage waveform representative a spoken word) such that the calculated root-mean-square of the manipulated waveform is within a defined tolerance of the defined root-mean-squared target value. The remaining method steps of FIG. 3 function substantially as described elsewhere herein.

Figure 4:
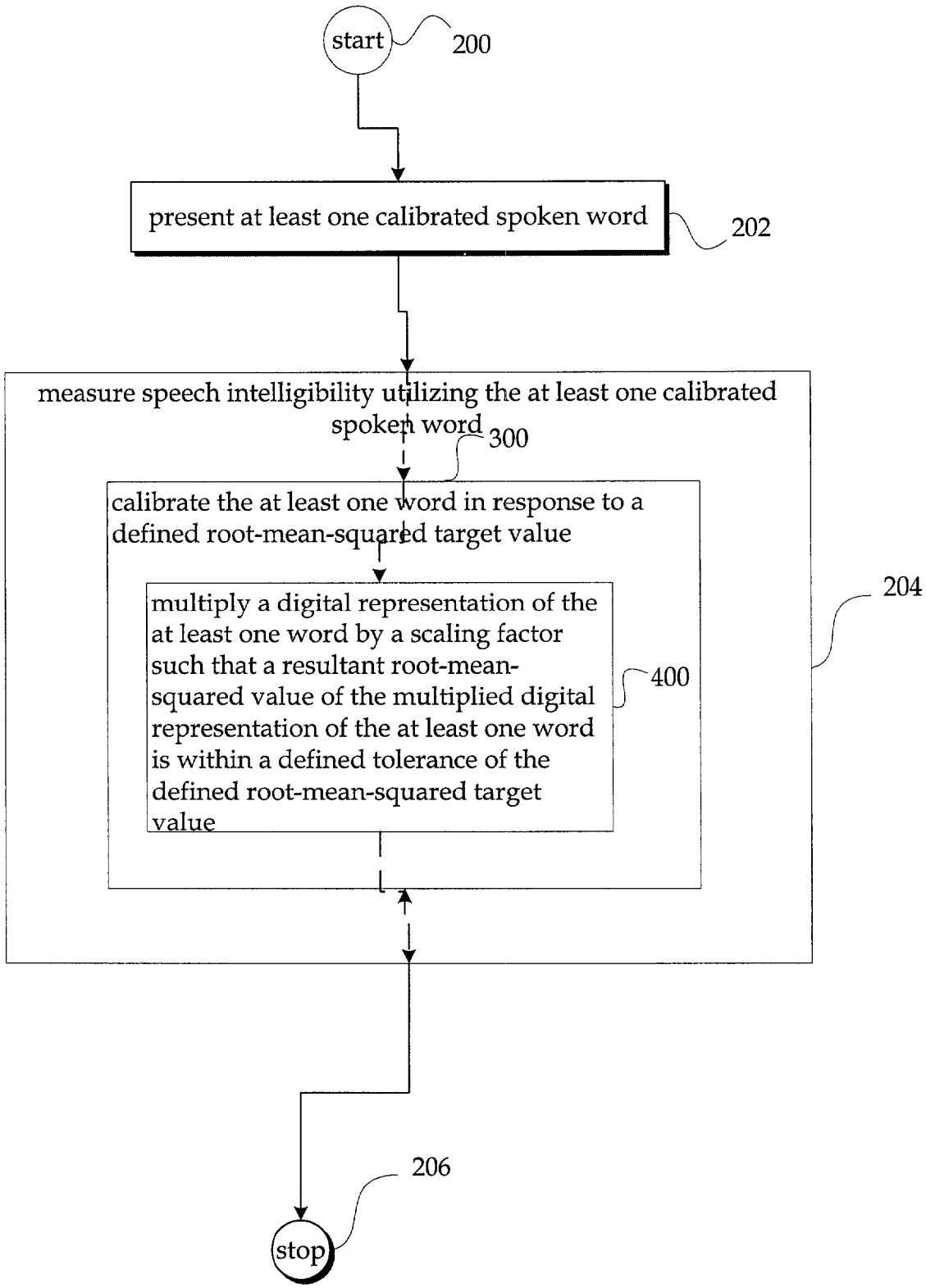
FIG. 4 shows an implementation of the high-level logic flowchart shown in FIG. 3.

With reference now to FIG. 4, shown is an implementation of the high-level logic flowchart shown in FIG. 3. Depicted in FIG. 4 is that in one implementation method sub-step 300 can include method sub-step 400. Illustrated is that in one implementation calibrating the at least one word in response to a defined root-mean-squared target value can include, but is not limited to, multiplying a discrete representation of the at least one word by a scaling factor such that a resultant root-mean-squared value of the multiplied discrete representation of the at least one word is within a defined tolerance of the defined root-mean-squared target value (e.g., with a defined percentage of the target value, such as +/−1%). In one device implementation, method step 400 is achieved via a computer program, running on data processing system 120, multiplying the discrete values of a data file by a scaling factor, where the discrete values of the data file constitute a waveform representative of a spoken word (e.g., a Microsoft WAV file containing a discrete data representation of a voltage waveform representative a spoken word) via use of equations and/or criteria set forth and discussed following. The remaining method steps of FIG. 4 function substantially as described elsewhere herein.

Figure 5:
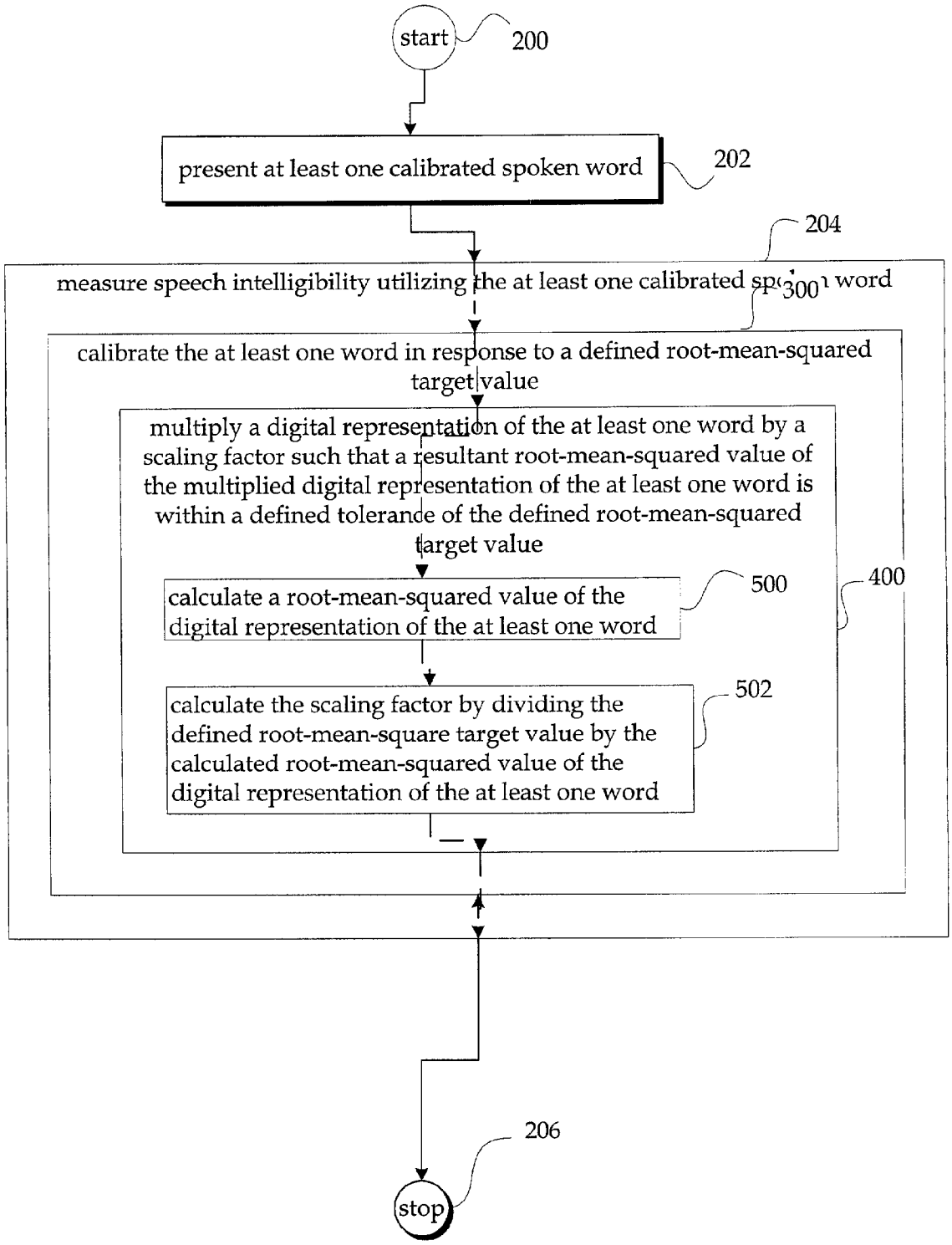
FIG. 5 shows an implementation of the high-level logic flowchart shown in FIG. 4.

With reference now to FIG. 5, shown is an implementation of the high-level logic flowchart shown in FIG. 4. Depicted in FIG. 5 is that in one implementation method step 400 can include, but is not limited to, method steps 500 and 502. Method step 500 illustrates calculating a root-mean-squared value of the digital representation of the at least one word. Method step 502 shows calculating the scaling factor by dividing the defined root-mean-square target value by the calculated root-mean-squared value of the digital representation of the at least one word. In one device implementation, method steps 500 and 502 are achieved via a computer program running on data processing system 120. The remaining method steps of FIG. 5 function substantially as described elsewhere herein.

Figure 6:
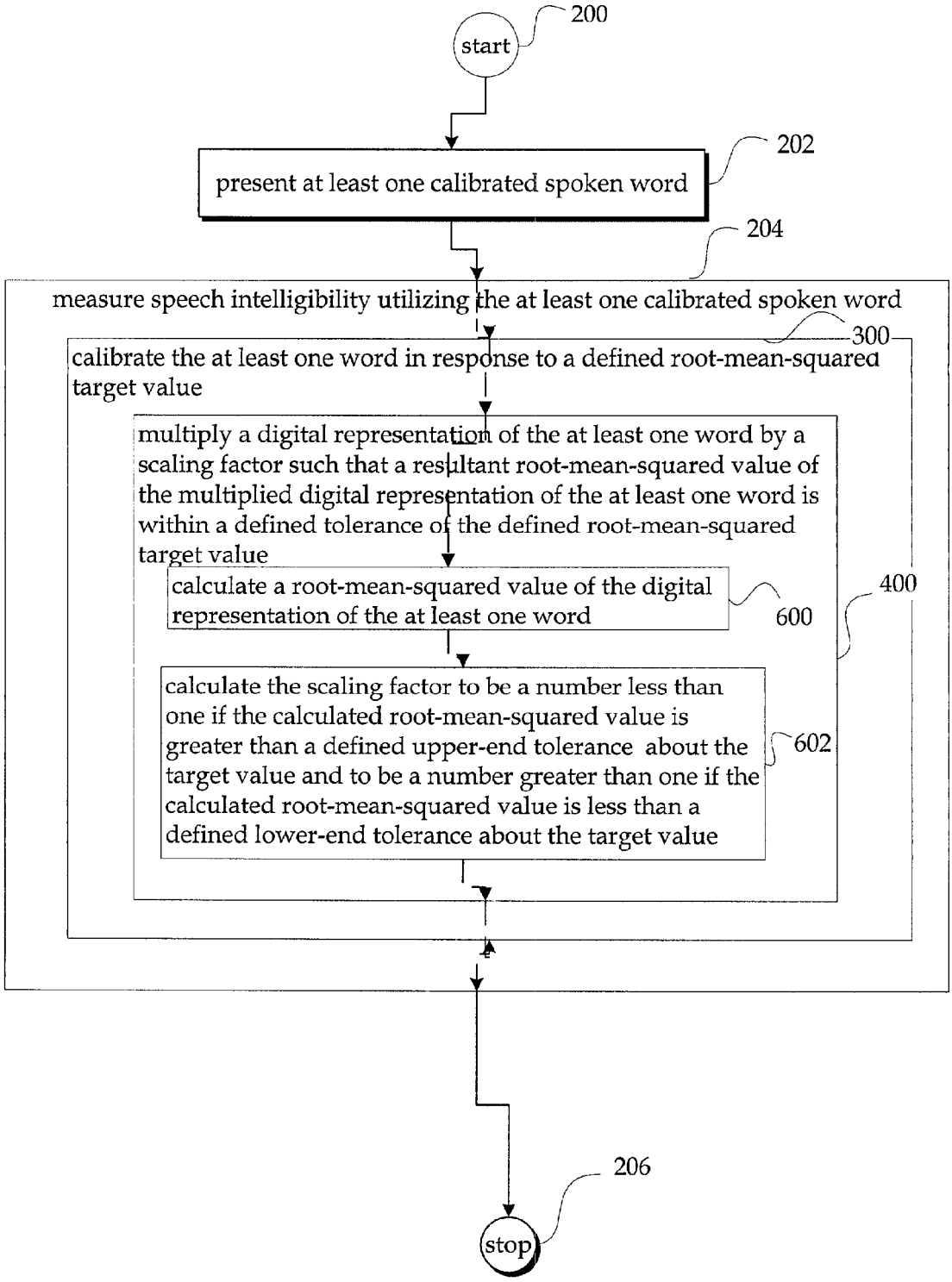
FIG. 6 shows an implementation of the high-level logic flowchart shown in FIG. 4.

With reference now to FIG. 6, shown is an implementation of the high-level logic flowchart shown in FIG. 4. Depicted in FIG. 6 is that in one implementation method step 400 can include, but is not limited to, method steps 600 and 602. Method step 600 illustrates calculating a root-mean-squared value of the digital representation of the at least one word. Method step 602 shows calculating the scaling factor to be a number less than one if the calculated root-mean-squared value is greater than a defined upper-end tolerance about the target value and to be a number greater than one if the calculated root-mean-squared value is less than a defined lower-end tolerance about the target value. In one device implementation, method steps 600 and 602 are achieved via a computer program running on data processing system 120. The remaining method steps of FIG. 6 function substantially as described elsewhere herein.

Referring now to FIG. 11, shown is an example of RMS calculation involving an assumed RMS, assumed tolerance values of +/−1% about the assumed target values, subsequent calculation of a scaling factor, and subsequent resultant scaled waveform values. Further shown is a calculation where a check is performed to illustrate that the calculated scaling factor did indeed give rise to a scaled waveform whose calculated RMS was within the defined tolerance values.

Figure 7:
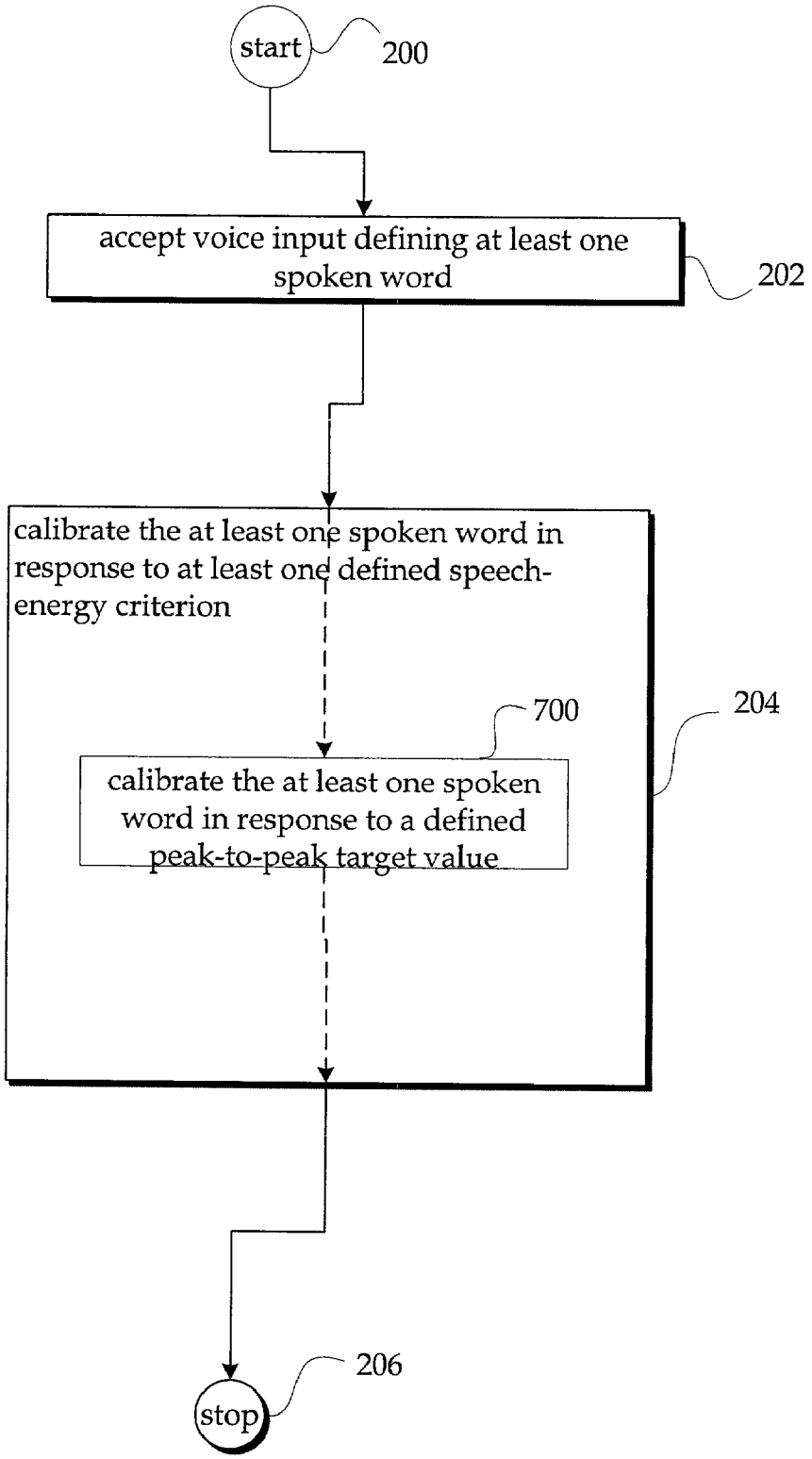
FIG. 7 shows an implementation of the high-level logic flowchart shown in FIG. 2.

With reference now to FIG. 7, shown is an implementation of the high-level logic flowchart shown in FIG. 2. Depicted in FIG. 7 is that method step 204 can include method sub-step 700. Depicted in FIG. 7 is that in one implementation calibrating the at least one spoken word in response to at least one defined speech-energy criterion can include, but is not limited to, calibrating the at least one spoken word in response to a defined peak-to-peak target value. In one device implementation, method sub-step 700 is achieved via a computer program, running on data processing system 120, calibrating the at least one spoken word in response to a defined peak-to-peak target value by manipulating a data file having a discrete representation of a waveform representative of a spoken word (e.g., a Microsoft WAV file containing a discrete data representation of a voltage waveform representative a spoken word) such that the greatest peak-to-peak value of the manipulated waveform is within a defined tolerance of the defined peak-to-peak target value. The remaining method steps of FIG. 7 function substantially as described elsewhere herein.

Figure 8:
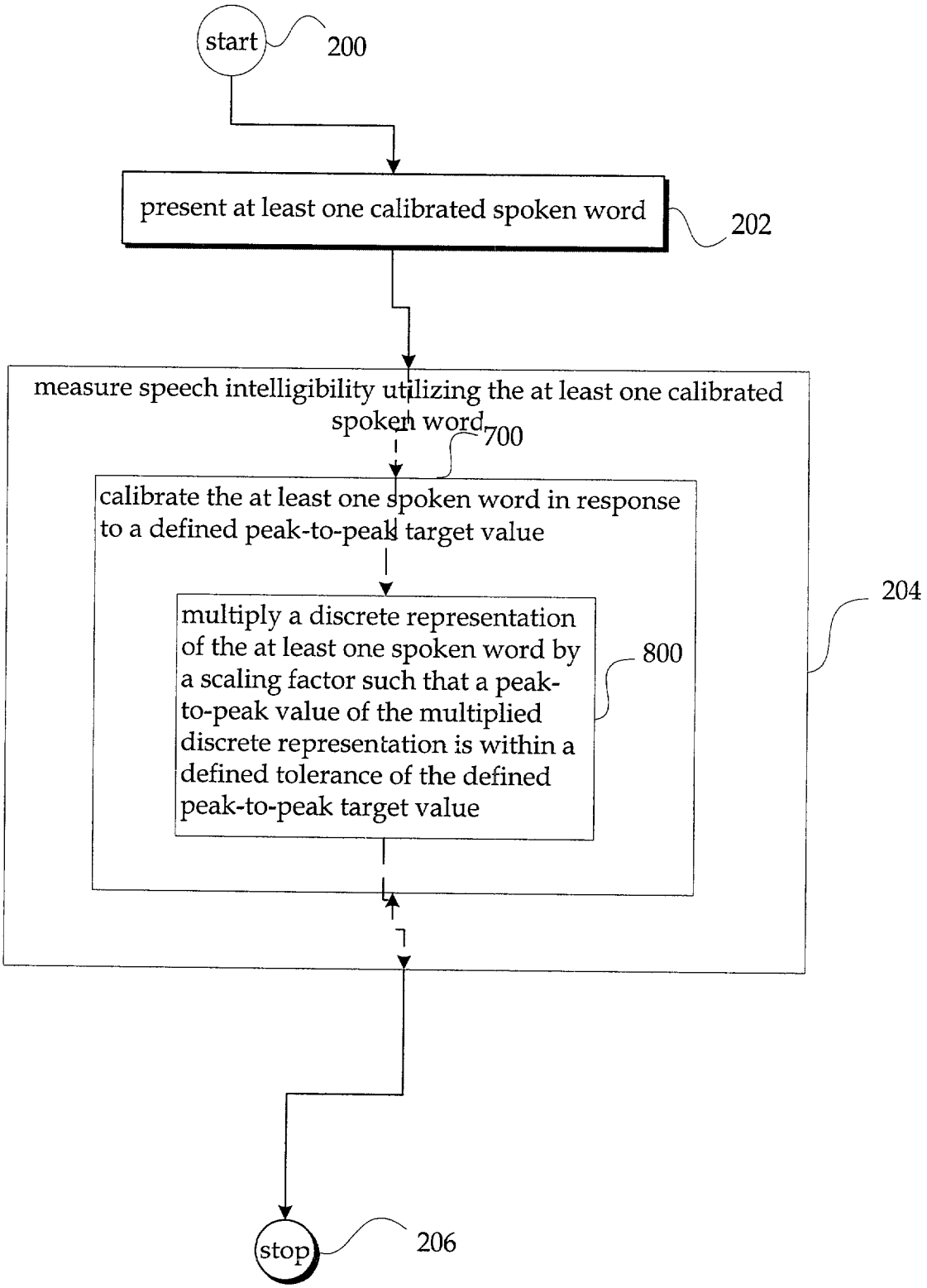
FIG. 8 shows an implementation of the high-level logic flowchart shown in FIG. 7.

With reference now to FIG. 8, shown is an implementation of the high-level logic flowchart shown in FIG. 7. Depicted in FIG. 8 is that in one implementation method sub-step 700 can include method sub-step 800. Illustrated is that in one implementation calibrating the at least one spoken word in response to a defined peak-to-peak target value can include, but is not limited to, multiplying a discrete representation of the at least one spoken word by a scaling factor such that a peak-to-peak value of the multiplied discrete representation is within a defined tolerance of the defined peak-to-peak target value. In one device implementation, method step 800 is achieved via a computer program, running on data processing system 120, multiplying the discrete values of a data file by the scaling factor, where the discrete values of the data file constitute a waveform representative of a spoken word (e.g., Microsoft WAV file containing a discrete data representation of a voltage waveform representative a spoken word) via use of equations and/or criteria set forth and discussed following. The remaining method steps of FIG. 8 function substantially as described elsewhere herein.

Figure 9:
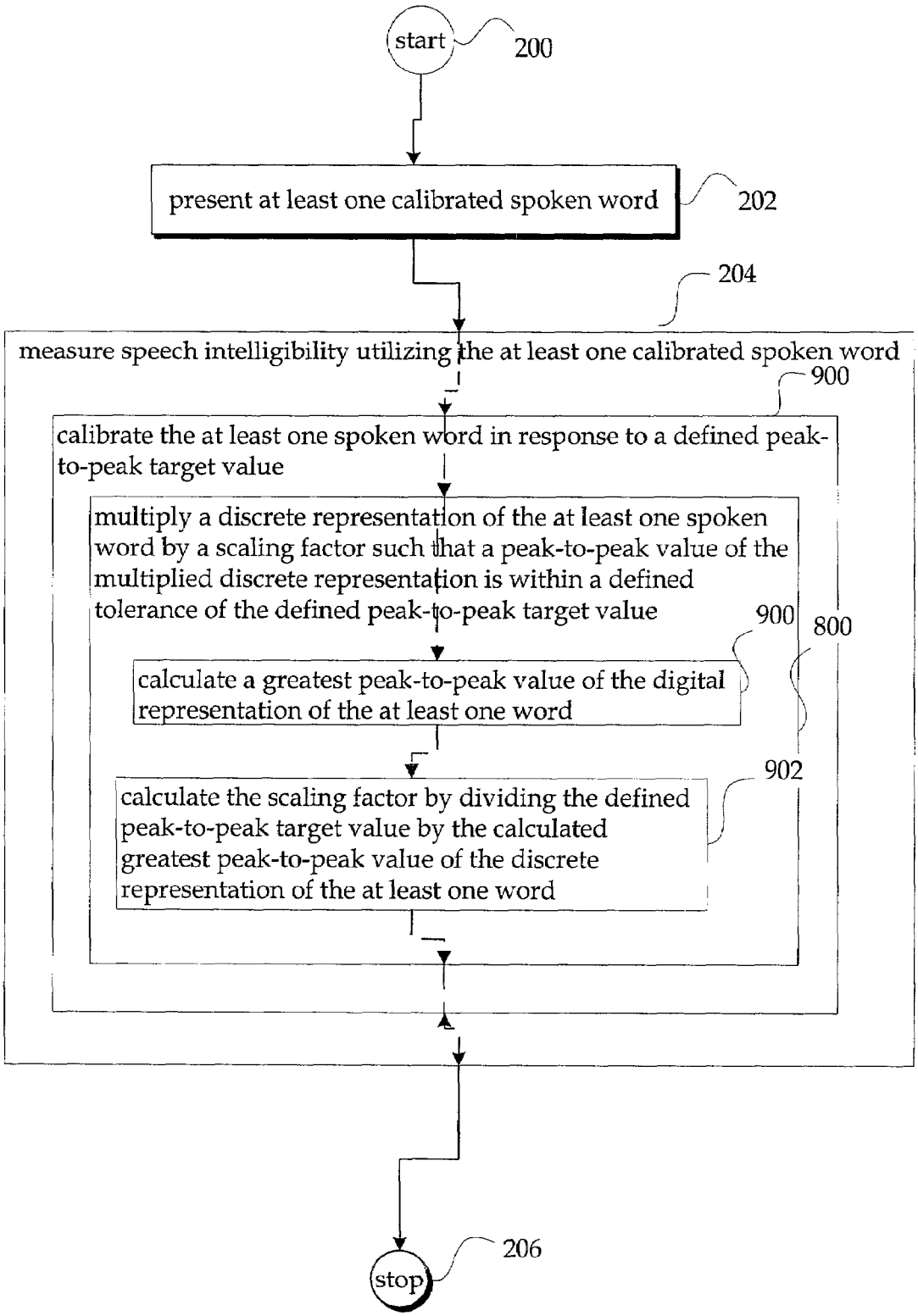
FIG. 9 shows an implementation of the high-level logic flowchart shown in FIG. 8.

With reference now to FIG. 9, shown is an implementation of the high-level logic flowchart shown in FIG. 8. Depicted in FIG. 9 is that in one implementation method step 800 can include, but is not limited to, method steps 900 and 902. Method step 900 illustrates calculating a greatest peak-to-peak value of the digital representation of the at least one word. Method step 902 shows calculating the scaling factor by dividing the defined peak-to-peak target value by the calculated greatest peak-to-peak value of the discrete representation of the at least one word. In one device implementation, method steps 900 and 902 are achieved via a computer program running on data processing system 120. The remaining method steps of FIG. 9 function substantially as described elsewhere herein.

Figure 10:
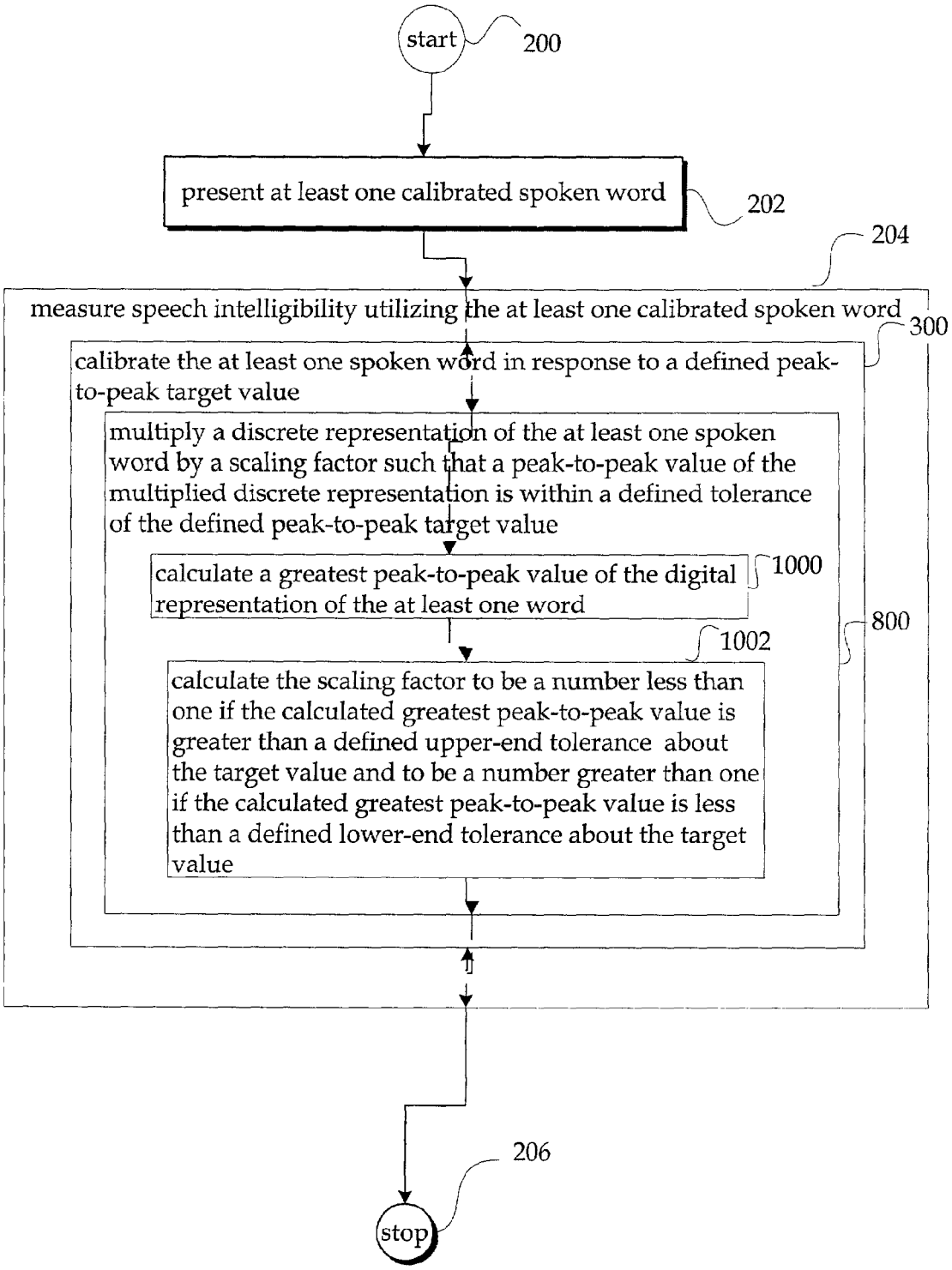
FIG. 10 shows an implementation of the high-level logic flowchart shown in FIG. 8.

With reference now to FIG. 10, shown is an implementation of the high-level logic flowchart shown in FIG. 8. Depicted in FIG. 10 is that in one implementation method sub-step 800 can include, but is not limited to, method steps 1000 and 1002. Method step 1000 illustrates calculating a greatest peak-to-peak value of the digital representation of the at least one word. Method step 1002 shows calculating the scaling factor to be a number less than one if the calculated greatest peak-to-peak value is greater than a defined upper-end tolerance about the target value and to be a number greater than one if the calculated greatest peak-to-peak value is less than a defined lower-end tolerance about the target value. In one device implementation, method steps 1000 and 1002 are achieved via a computer program running on data processing system 120. The remaining method steps of FIG. 6 function substantially as described elsewhere herein.

Those having ordinary skill in the art will recognize that the state of the art has progressed to the point where there is little distinction left between hardware and software implementations of aspects of systems; the use of hardware or software is generally (but not always, in that in certain contexts the choice between hardware and software can become significant) a design choice representing cost vs. efficiency tradeoffs. Those having ordinary skill in the art will appreciate that there are various vehicles by which processes and/or systems described herein can be effected (e.g., hardware, software, and/or firmware), and that the preferred vehicle will vary with the context in which the processes are deployed. For example, if an implementer determines that speed and accuracy are paramount, the implementer may opt for a hardware and/or firmware vehicle; alternatively, if flexibility is paramount, the implementer may opt for a solely software implementation; or, yet again alternatively, the implementer may opt for some combination of hardware, software, and/or firmware. Hence, there are several possible vehicles by which the processes described herein may be effected, none of which is inherently superior to the other in that any vehicle to be utilized is a choice dependent upon the context in which the vehicle will be deployed and the specific concerns (e.g., speed, flexibility, or predictability) of the implementer, any of which may vary.

The foregoing detailed description has set forth various embodiments of the devices and/or processes via the use of block diagrams, flowcharts, and examples. Insofar as such block diagrams, flowcharts, and examples contain one or more functions and/or operations, it will be understood as notorious by those within the art that each function and/or operation within such block diagrams, flowcharts, or examples can be implemented, individually and/or collectively, by a wide range of hardware, software, firmware, or virtually any combination thereof. In one embodiment, the present invention may be implemented via Application Specific Integrated Circuits (ASICs). However, those skilled in the art will recognize that the embodiments disclosed herein, in whole or in part, can be equivalently implemented in standard Integrated Circuits, as one or more computer programs running on one or more computers (e.g., as one or more programs running on one or more computer systems), as one or more programs running on one or more processors (e.g., as one or more programs running on one or more processors), as firmware, or as virtually any combination thereof, and that designing the circuitry and/or writing the code for the software and or firmware would be well within the skill of one of ordinary skill in the art in light of this disclosure. In addition, those skilled in the art will appreciate that the mechanisms of the present invention are capable of being distributed as a program product in a variety of forms, and that an illustrative embodiment of the present invention applies equally regardless of the particular type of signal bearing media used to actually carry out the distribution. Examples of a signal bearing media include, but are not limited to, the following: recordable type media such as floppy disks, hard disk drives, CD ROMs, digital tape, and computer memory; and transmission type media such as digital and analogue communication links using TDM or IP based communication links (e.g., packet links).

In a general sense, those skilled in the art will recognize that the various embodiments described herein which can be implemented, individually and/or collectively, by a wide range of hardware, software, firmware, or any combination thereof can be viewed as being composed of various types of "electrical circuitry." Consequently, as used herein "electrical circuitry" includes, but is not limited to, electrical circuitry having at least one discrete electrical circuit, electrical circuitry having at least one integrated circuit, electrical circuitry having at least one application specific integrated circuit, electrical circuitry forming a general purpose computing device configured by a computer program (e.g., a general purpose computer configured by a computer program which at least partially carries out processes and/or devices described herein, or a microprocessor configured by a computer program which at least partially carries out processes and/or devices described herein), electrical circuitry forming a memory device (e.g., forms of random access memory), and electrical circuitry forming a communications device (e.g., a modem, communications switch, or optical-electrical equipment).

Those skilled in the art will recognize that it is common within the art to describe devices and/or processes in the fashion set forth herein, and thereafter use standard engineering practices to integrate such described devices and/or processes into data processing systems. That is, the devices and/or processes described herein can be integrated into a data processing system via a reasonable amount of experimentation. FIGS. 1A–C shows an example representation of a data processing system into which at least a part of the herein described devices and/or processes may be integrated with a reasonable amount of experimentation.

With reference now again to FIGS. 1A–C, depicted is a pictorial representation of a conventional data processing system in which portions of the illustrative embodiments of the devices and/or processes described herein may be implemented. It should be noted that graphical user interface systems (e.g., Microsoft Windows 98 or Microsoft Windows NT operating systems) and methods can be utilized with the data processing system depicted in FIGS. 1A–C. Data processing system 120 is depicted which includes system unit housing 122, video display device 124, keyboard 126, mouse 128, and microphone 148. Data processing system 120 may be implemented utilizing any suitable commercially available computer.

The foregoing described embodiments depict different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality.

While particular embodiments of the present invention have been shown and described, it will be obvious to those skilled in the art that, based upon the teachings herein, changes and modifications may be made without departing from this invention and its broader aspects and, therefore, the appended claims are to encompass within their scope all such changes and modifications as are within the true spirit and scope of this invention. Furthermore, it is to be understood that the invention is solely defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations).

From the foregoing it will be appreciated that, although specific embodiments of the invention have been described herein for purposes of illustration, various modifications may be made without deviating from the spirit and scope of the invention. Accordingly, the invention is not limited except as by the appended claims.

The invention claimed is:

1. A method comprising:

accepting voice input defining at least one spoken word;

calibrating the at least one spoken word in response to at least one defined speech-energy criterion, wherein said calibrating includes setting a target RMS value, setting a tolerance value within a predefined range of the target RMS value, calculating an actual RMS value, calculating a scaling factor and applying the scaling factor to the actual RMS value if the actual RMS value is not within the tolerance value and determining if the scaled RMS value is within the tolerance value.

2. The method of claim 1, wherein said calibrating the at least one word in response to at least one defined speech-energy criterion comprises:

calibrating the at least one spoken word in response to a defined root-mean-squared target value.

3. The method of claim 2, wherein said calibrating the at least one word in response to a defined root-mean-squared target value comprises:

multiplying a discrete representation of the at least one word by a scaling factor such that a resultant root-mean-squared value of the multiplied discrete representation of the at least one word is within a defined tolerance of the defined root-mean-squared target value.

4. The method of claim 3, wherein said multiplying a discrete representation of the at least one word by a scaling factor such that a resultant root-mean-squared value of the multiplied discrete representation of the at least one word is within a defined tolerance of the defined root-mean-squared target value comprises calculating a scaling factor.

5. The method of claim 4, wherein said calculating a scaling factor comprises:

calculating a root-mean-squared value of the discrete representation of the at least one word; and calculating the scaling factor by dividing the defined root-mean-square target value by the calculated root-mean-squared value of the discrete representation of the at least one word.

6. The method of claim 4, wherein said calculating a scaling factor comprises:

calculating a root-mean-squared value of the discrete representation of the at least one word; and calculating the scaling factor to be a number less than one if the calculated root-mean-squared value is greater than a defined upper-end tolerance about the target value and to be a number greater than one if the calculated root-mean-squared value is less than a defined lower-end tolerance about the target value.

7. The method of claim 3, wherein the discrete representation of the at least one word comprises seperate respective discrete representations for each word of the at least one word.

8. The method of claim 1, wherein said calibrating the at least one spoken word in response to at least one defined speech-energy criterion comprises:

calibrating the at least one spoken word in response to a defined peak-to-peak target value.

9. The method of claim 8, wherein said calibrating the at least one spoken word in response to a defined peak-to-peak target value comprises:

multiplying a discrete representation of the at least one spoken word by a scaling factor such that a peak-to-peak value of the multiplied discrete representation is within a defined tolerance of the defined peak-to-peak target value.

10. The method of claim 9, wherein said multiplying a discrete representation of the at least one spoken word by a scaling factor such that a peak-to-peak value of the multiplied discrete representation is within a defined tolerance of the defined peak-to-peak target value comprises:

calculating a scaling factor.

11. The method of claim 10, wherein said calculating a scaling factor comprises:

calculating a greatest peak-to-peak value of the discrete representation of the at least one word; and calculating the scaling factor by dividing the defined peak-to-peak target value by the calculated peak-to-peak value of the discrete representation of the at least one word.

12. The method of claim 10, wherein said calculating a scaling factor comprises:

calculating a greatest peak-to-peak value of the discrete representation of the at least one word; and calculating the scaling factor to be a number less than one if the calculated greatest peak-to-peak value is greater than a defined upper-end tolerance about the target value and to be a number greater than one if the calculated greatest peak-to-peak value is less than a defined lower-end tolerance about the target value.

13. A system comprising:

means for accepting voice input defining at least one spoken word; and means for calibrating the at least one spoken word in response to at least one defined speech-energy criterion, wherein said calibrating includes setting a target RMS value, setting a tolerance value within a predefined range of the target RMS value, calculating an actual RMS value, calculating a scaling factor and applying the scaling factor to the actual RMS value if the actual RMS value is not within the tolerance value and determining if the scaled RMS value is within the tolerance value.

14. The system of claim 13, wherein said means for calibrating the at least one word in response to at least one defined speech-energy criterion comprises:

means for calibrating the at least one spoken word in response to a defined root-mean-squared target value.

15. The system of claim 14, wherein said means for calibrating the at least one word in response to a defined root-mean-squared target value comprises:

means for multiplying a discrete representation of the at least one word by a scaling factor such that a resultant root-mean-squared value of the multiplied discrete representation of the at least one word is within a defined tolerance of the defined root-mean-squared target value.

16. The system of claim 15, wherein said means for multiplying a discrete representation of the at least one word by a scaling factor such that a resultant root-mean-squared value of the multiplied discrete representation of the at least one word is within a defined tolerance of the defined root-mean-squared target value comprises:

means for calculating a scaling factor.

17. The system of claim 16, wherein said means for calculating a scaling factor comprises:

means for calculating a root-mean-squared value of the discrete representation of the at least one word; and means for calculating the scaling factor by dividing the defined root-mean-squared target value by the calculated root-mean-squared value of the discrete representation of the at least one word.

18. The system of claim 16, wherein said means for calculating a scaling factor comprises:

means for calculating a root-mean-squared value of the discrete representation of the at least one word; and means for calculating the scaling factor to be a number less than one if the calculated root-mean-squared value is greater than a defined upper-end tolerance about the target value and to be a number greater than one if the calculated root-mean-squared value is less than a defined lower-end tolerance about the target value.

19. The system of claim 13, wherein said means for calibrating the at least one spoken word in response to at least one defined speech-energy criterion comprises:

means for calibrating the at least one spoken word in response to a defined peak-to-peak target value.

20. The system of claim 19, wherein said means for calibrating the at least one spoken word in response to a defined peak-to-peak target value comprises:

means for multiplying a discrete representation of the at least one spoken word by a scaling factor such that a peak-to-peak value of the multiplied discrete representation is within a defined tolerance of the defined peak-to-peak target value.

21. The system of claim 20, wherein said means for multiplying a discrete representation of the at least one spoken word by a sealing factor such that a peak-to-peak value of the multiplied discrete representation is within a defined tolerance of the defined peak-to-peak target value comprises:

means for calculating a scaling factor.

22. The system of claim 21, wherein said means for calculating a scaling factor comprises:

means for calculating a greatest peak-to-peak value of the discrete representation of the at least one word; and means for calculating the scaling factor by dividing the defined peak-to-peak target value by the calculated peak-to-peak value of the discrete representation of the at least one word.

23. The system of claim 21, wherein said means for calculating a scaling factor comprises:

means for calculating a greatest peak-to-peak value of the discrete representation of the at least one word; and means for calculating the scaling factor to be a number less than one if the calculated greatest peak-to-peak value is greater than a defined upper-end tolerance about the target value and to be a number greater than one if the calculated greatest peak-to-peak value is less than a defined lower-end tolerance about the target value.

* * * * *